US006069595A

United States Patent [19]

Tokimoto

[11] Patent Number: 6,069,595

[45] Date of Patent: May 30, 2000

[54] SCROLL DISPLAY METHOD AND APPARATUS

[76] Inventor: Toyotaro Tokimoto, 200-30, Mutsuura-cho, Kanazawa-ku, Yokohama-shi, Kanagawa, Japan

[21] Appl. No.: 08/973,532

[22] PCT Filed: Apr. 16, 1997

[86] PCT No.: PCT/JP97/01315

§ 371 Date: Dec. 10, 1997

§ 102(e) Date: Dec. 10, 1997

[87] PCT Pub. No.: WO97/39438

PCT Pub. Date: Oct. 23, 1997

[30] Foreign Application Priority Data

Apr. 16, 1996 [JP] Japan ..... 8-93787

[51] Int. Cl.[7] ..... G09G 3/06

[52] U.S. Cl. ..... 345/44; 345/56; 40/610

[58] Field of Search ..... 345/44, 56, 46, 345/30, 31, 39, 123, 124, 125, 82, 55, 127, 131; 40/610, 605, 606

[56] References Cited

U.S. PATENT DOCUMENTS 5,302,965 4/1994 Belcher et al. ..... 345/31
5,767,822 6/1998 Hiroshi ..... 345/46
5,900,850 5/1999 Bailey et al. ..... 345/55

FOREIGN PATENT DOCUMENTS 3-73995 3/1991 Japan .
4-12277 1/1992 Japan .
4-85489 7/1992 Japan .
4-504624 8/1992 Japan .
8-179717 7/1996 Japan .
9-114415 5/1997 Japan .
9-134143 5/1997 Japan .

*Primary Examiner*—Richard A. Hjerpe
*Assistant Examiner*—Francis Nguyen
*Attorney, Agent, or Firm*—Barnes & Thornburg

[57] ABSTRACT

When a large number of bar-shaped display elements are installed at a site in any of various situations, even if the distances between the bar-shaped display elements are not necessarily fixed, an image of an aspect ratio which is correct over an entire screen can be displayed without distorting the displayed image. Data distribution means includes means for storing a standard value set corresponding to a standard arrangement distance of the bar-shaped display elements Bi as an interval control variable, and means for storing a correction value set for a particular bar-shaped display element B8 arranged in a displaced condition from the standard arrangement distance, and selectively extracts image data for one column to be distributed to each of the bar-shaped display elements B1 to B10 based on the standard value and the correction value.

8 Claims, 7 Drawing Sheets

SCROLL DISPLAY METHOD AND APPARATUS

CROSS-REFERENCES TO RELATED APPLICATIONS

This application is a U.S. national application of international application serial. No. PCT/JP97/01315 filed Apr. 16, 1997, which claims priority to Japanese Serial No. 8-93787 filed Apr. 16, 1996.

TECHNICAL FIELD

This invention relates to a method of and an apparatus for scrolling displaying characters or a graphic form on a light emitting cell array wherein light emitting cells such as high luminance LEDs (light emitting diodes) are arranged two-dimensionally.

BACKGROUND ART

Display panels of the dot matrix type wherein light emitting cells such as LEDs are arranged at fixed distances in rows and columns have spread popularly and widely. On a simple LED display panel which is used for a guide display in an electric car or an advertisement display of a store, principally a character train is scrolling displayed on a display panel of a limited size. For example, character train data of the bit map type wherein one character is composed of 16×16 dots are successively produced and displayed by scrolling on a display panel of the dot matrix type wherein sixteen (16) dots are arranged in a column and a number of dots greater than at least several times as large as sixteen (16) are arranged in a row.

For example, where a character train is displayed by feeding (displayed by scrolling) in a horizontal direction on such a horizontally elongated display panel of the dot matrix type as described above, in order to increase the number of characters which can be displayed at a time, naturally the number of dots in the horizontal direction of the display panel must be increased. Accordingly, a considerable increase in cost is required for such simple expansion of a display panel.

Meanwhile, if the distances between light emitting cells arranged in rows and columns are increased to increase the size of a display panel in order to provide a display of a large size, a display image becomes very rough and the display quality is deteriorated remarkably. Therefore, the size of a display panel is increased by increasing the number of light emitting cells without increasing the distances between the light emitting cells very much. Meanwhile, the definition of display data is increased by constructing one character with 32×32 dots or the like. By such countermeasures, a display of a large size and a high quality can be obtained. However, a remarkable increase in cost must be expected for the countermeasures.

Further, in a conventional display panel of the dot matrix type, irrespective of whether the size thereof is large or small, a large number of light emitting cells are mounted on a circuit board and accommodated in a flat panel type case together with a drive circuit. Naturally, the display panel has a rigid body and is not so flexible as to allow it to be folded freely (although it may be divided into several parts), divided into small parts or contracted or expanded. While a display panel of a very small size can be carried entirely (some display panels for advertisement of a store are portable), most of display panels of the type described are installed fixedly at predetermined locations. This apparatus form is considered to be one of obstacles to expansion in application.

SUMMARY OF THE INVENTION

The present invention has been made in view of the conventional problems described above, and particularly, in order to attain the following and other objects:

(a) to provide a scrolling display method and apparatus by which a definite image of a large size can be displayed with a small number of light emitting cells;

(b) to provide a scrolling display method and apparatus by which a display screen of a large size can be realized not in an apparatus form of a display panel of a rigid body having a size a little larger than a display size but in a flexible apparatus form wherein a large number of bar-shaped display elements are arranged at suitable distances; and (c) to provide a scrolling display method and apparatus by which, in working the present invention by installing a large number of bar-shaped display elements at a site in any of various situations, even if the distances between the bar-shaped display elements are not necessarily fixed, an image of an aspect ratio which is correct over an entire screen can be displayed without distorting the displayed image.

The scrolling display method and apparatus of the present invention includes the following features:

n bar-shaped display elements, each of which including m light emitting cells positioned linearly and closely at short distances, are arranged substantially in parallel to each other at suitable distances from each other, so that, by the arrangement, the n bar-shaped display elements are connected to each other like a belt to form a physical screen wherein one column includes m dots and one row include n dots;

the arrangement distances of the n bar-shaped display elements are sufficiently rough and an average distance of the same is larger than several times as large as the cell distance in one of the bar-shaped display elements;

the physical screen of a pixel construction wherein one column includes m dots and one row includes n dots is assumed as an imaginary screen of another pixel construction wherein one column includes m dots and one row includes w dots, and image data of the bit map type are produced assuming that an image is displayed in the dot density on the imaginary screen, where w is an integer larger than several times as large as n;

the n bar-shaped display elements which compose the physical screen are distributed and arranged substantially uniformly in average in the imaginary screen;

if it is assumed that bit map screen data wherein one column includes m dots and one row includes w dots are expanded on the imaginary screen to display the data, those image data for n columns selected at intervals from among the image data for w columns are distributed actually to the n bar-shaped display elements and the m light emitting cells of each of the bar-shaped display elements are controlled and driven in accordance with data of m dots for each column;

in the control to select image data for n columns at intervals from among image data for w columns and distribute the selected image data to the n bar-shaped display elements, the column distances in selection at intervals depend upon an interval control variable which can be set arbitrarily in accordance with the arrangement distances of the bar-shaped display elements distributed and arranged on the imaginary screen; and while those bit map image data to be expanded on the imaginary screen are successively shifted in a direction of a row, data processing for controlling and driving the light emitting cells of the bar-shaped display elements in accordance with image data selected at intervals is repeated so that a scrolling image of a dot density wherein one column includes m dots and one row includes w dots may be visually observed by an after-image effect of a person who watches the imaginary screen.

According to one aspect of the present invention, the scrolling display apparatus comprises data distribution means for specifying image data for w columns of one frame to be displayed subsequently from among entire image data produced in the form of a bit map and stored in a memory in accordance with a frame address and for selecting image data for n columns at intervals from the image data for w columns of one frame and distributing the selected image data to the bar-shaped display elements, light emission driving means for controlling and driving the m light emitting cells of each of the bar-shaped display elements in accordance with the image data of m dots for one column received from the data distribution means at a predetermined timing, and frame shifting means for successively updating the frame address to successively shift the frame to be specified from within the entire image data in a scrolling direction.

According to another aspect of the present invention, the data distribution means includes means for storing a standard value set corresponding to a standard arrangement distance of the bar-shaped display elements as the interval control variable, and means for storing a correction value set for a particular one of the bar-shaped display elements which is arranged in a displaced condition from the standard arrangement distance, and the data distribution means selectively extracts image data for one column to be distributed to each of the bar-shaped display elements based on the standard value and the correction value.

According to yet another aspect of the present invention, the scrolling display apparatus comprises, as a man-machine interface, means for arbitrarily setting and inputting the standard value, and means for setting and inputting the correction value in a corresponding relationship to an identifier of a pertaining one of the bar-shaped display elements.

According to further aspect of the present invention, the data distribution means includes means for storing, as the interval control variable, position data set proportionally corresponding to the arrangement position of each of the bar-shaped display elements from an origin, and selectively extracts image data for one column to be distributed to each of the bar-shaped display elements based on the position data.

According to still further aspect of the present invention, the scrolling display apparatus comprises, as a man-machine interface, means for setting and inputting the position data in a corresponding relationship to an identifier of each of the bar-shaped display elements.

According to yet further aspect of the present invention, the data distribution means includes means for storing, as the interval control variable, distance data set proportionally corresponding to the distance of each of the bar-shaped display elements from an adjacent one of the bar-shaped display elements, and selectively extracts image data for one column to be distributed to each of the bar-shaped display elements based on the distance data.

According to yet further aspect of the present invention, the scrolling display apparatus comprises, as a man-machine interface, means for setting and inputting the distance data in a corresponding relationship to an identifier of each of the bar-shaped display elements.

DESCRIPTION OF PREFERRED EMBODIMENTS

====Basic Form and Display Principle of Scrolling Display====

Figure 1:
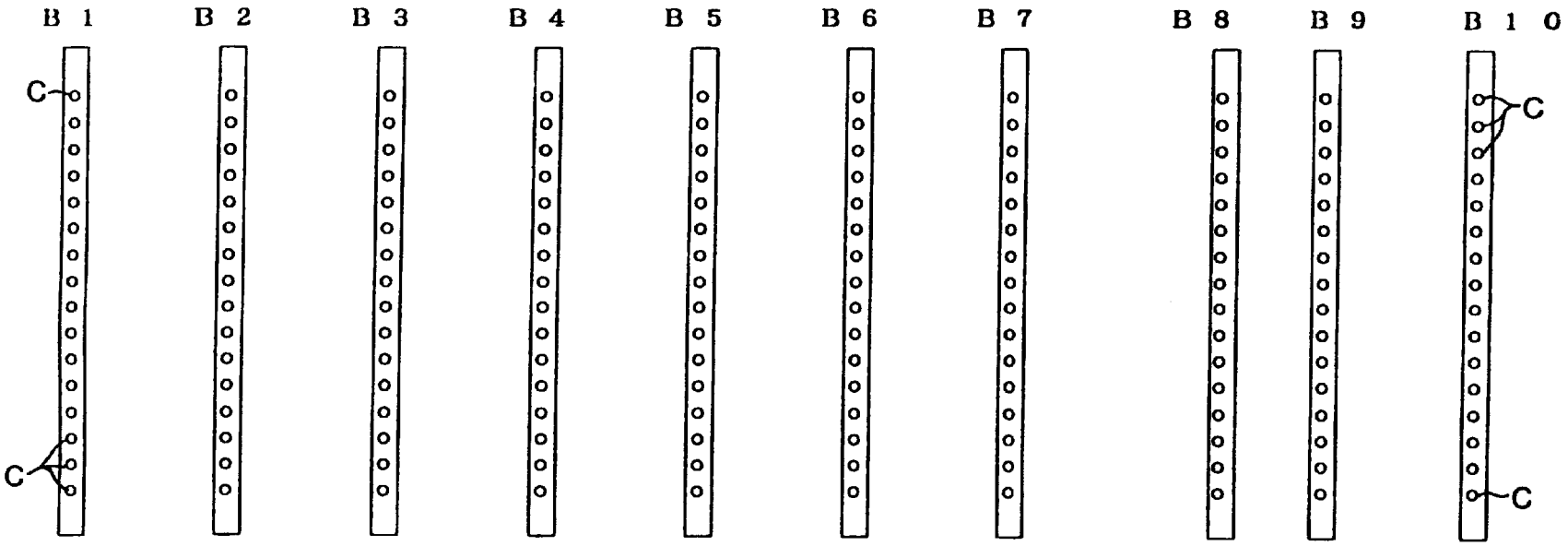
FIG.1 is a schematic view of a physical screen realized by an arrangement of bar-shaped display elements according to an embodiment of the present invention.

As shown in FIG. 1, n=ten (10) bar-shaped display elements Bi each formed from m=sixteen (16) light emitting cells C arranged linearly and densely at short distances are provided, and the bar-shaped display elements B1 to B10 are arranged substantially in parallel to each other at suitable distances from each other so that, by the arrangement, the bar-shaped display elements B1 to B10 are connected to each other like a belt to form a physical screen wherein one column includes sixteen (16) dots and one row includes ten (10) dots. The arrangement distances of the ten (10) bar-shaped display elements B1 to B10 are sufficiently rough, and an average distance of the same is approximately six times as large as the distance between the light emitting cells C of one of the bar-shaped display elements Bi.

The physical screen wherein one column includes sixteen (16) dots and one row includes ten (10) dots is assumed as an imaginary screen of a screen construction wherein one column includes m=16 dots and one row includes w=55 dots, and image data of the bit map type are produced assuming that an image is displayed in the dot density on the imaginary screen. In the present example, w is 5.5 times as large as n. Further, the ten (10) bar-shaped display elements B1 to B10 which compose the physical screen described above are distributed and arranged substantially uniformly in average in the imaginary screen.

Figure 3:
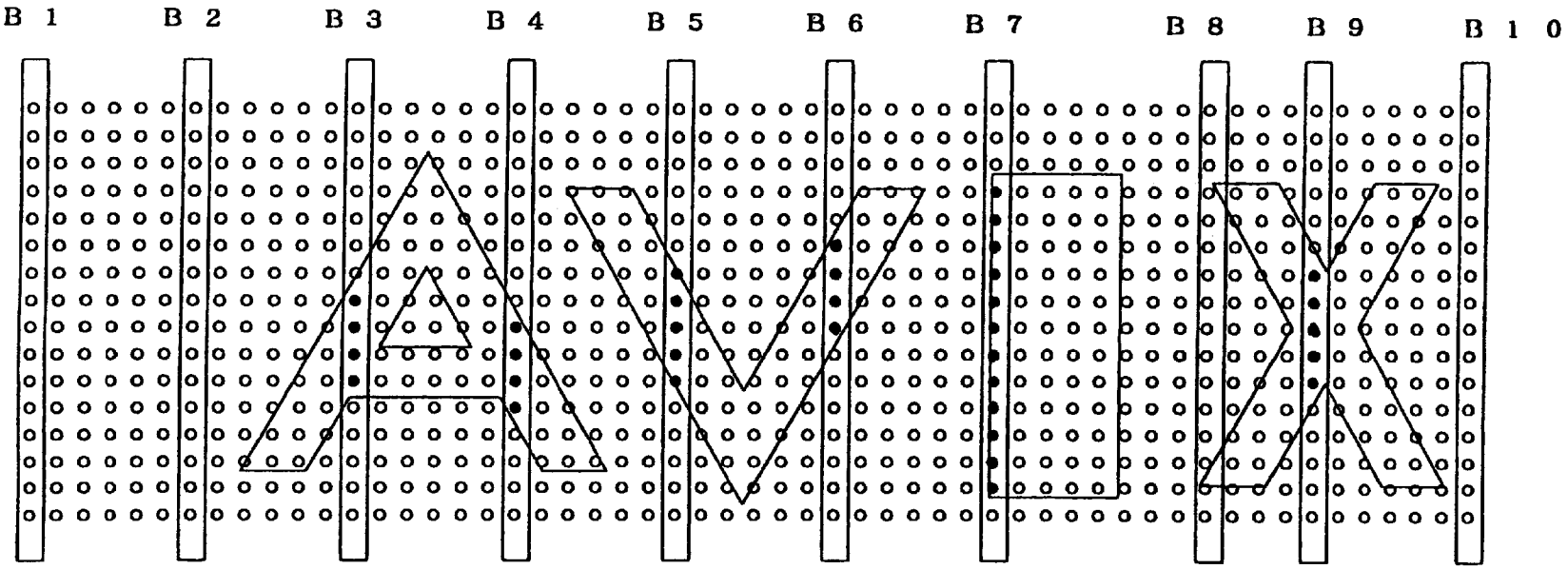
FIG. 3 is a schematic view illustrating a relationship among the physical screen, the imaginary screen, and image data to be scrolling displayed.

If it is assumed that bit map screen data wherein one column includes sixteen (16) dots and one row includes fifty five (55) dots (an image of a character train of "AVIX"), are expanded on the imaginary screen to display the data as seen in FIG. 3, actually those image data for ten (10) columns selected at intervals from among the image data for fifty five (55) columns are distributed to the ten (10) bar-shaped display elements B1 to B10 and the sixteen (16) light emitting cells C of each of the bar-shaped display elements Bi are controlled in accordance with data of sixteen (16) dots for each column.

In the control to select image data for ten (10) columns at intervals from among image data for fifty five (55) columns and distribute them to the ten (10) bar-shaped display elements B1 to B10, the column distances in selection at intervals depend upon an interval control variable which can be set arbitrarily in accordance with the arrangement distances of the bar-shaped display elements B1 to B10 distributed and arranged on the imaginary screen.

Figure 4:
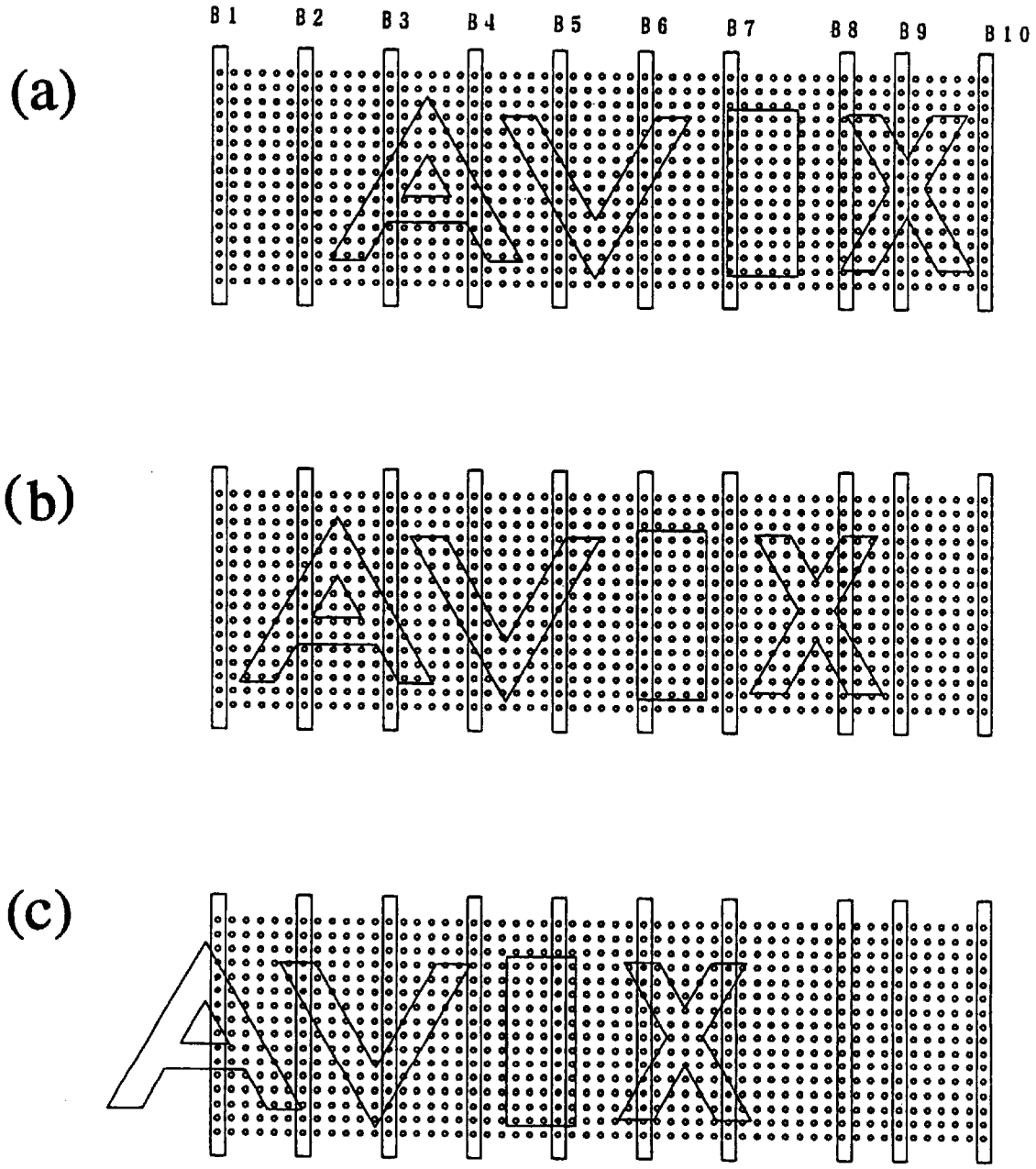
FIG.4 is a schematic view illustrating a manner in which an image is scrolled in FIG.3.

While those bit map image data to be expanded on the imaginary screen are successively shifted in a direction of a row, data processing for controlling and driving the light emitting cells C of the bar-shaped display elements B1 to B10 in accordance with image data selected at intervals in such a manner as described above is repeated so that, for example, as seen in FIG. 4, a scrolling image of a dot density wherein one column includes sixteen (16) dots and one row includes fifty five (55) dots may be visually observed by an after-image effect of a person who watches the imaginary screen.

====Detailed Construction and Operation of Scrolling Display Apparatus====

Figure 2:
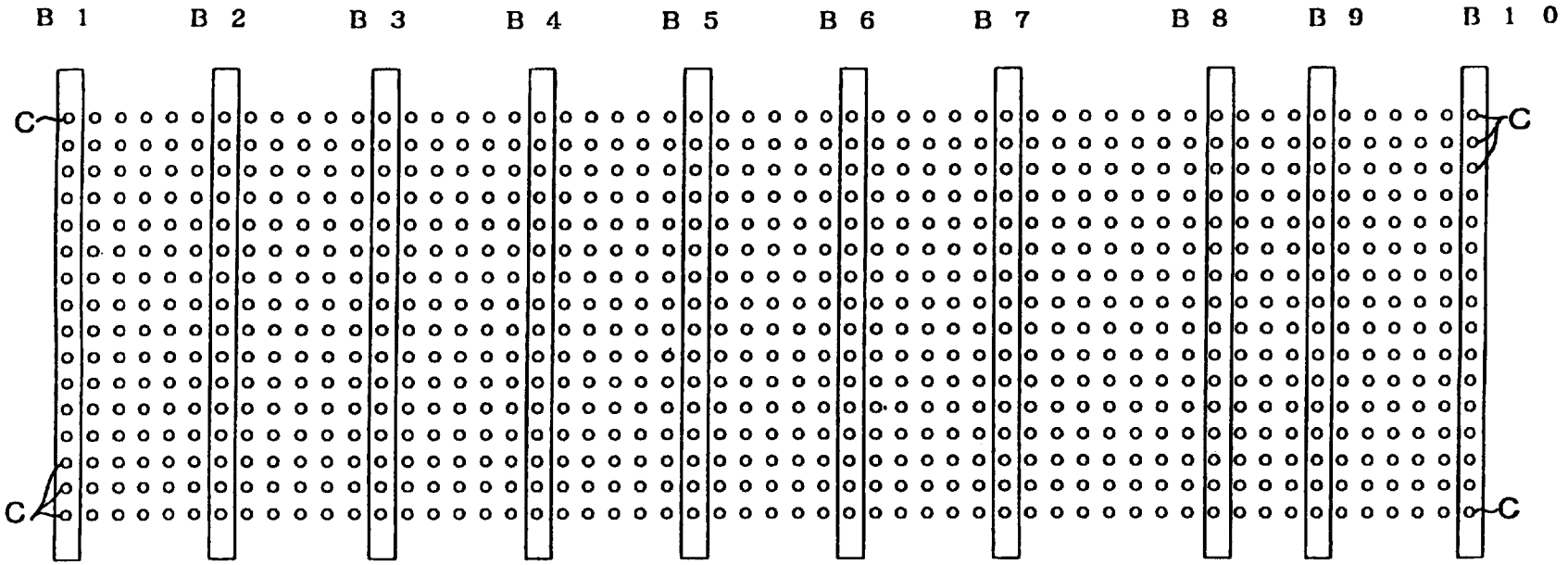
FIG.2 is a schematic view of an imaginary screen formed corresponding to the physical screen.
Figure 5:
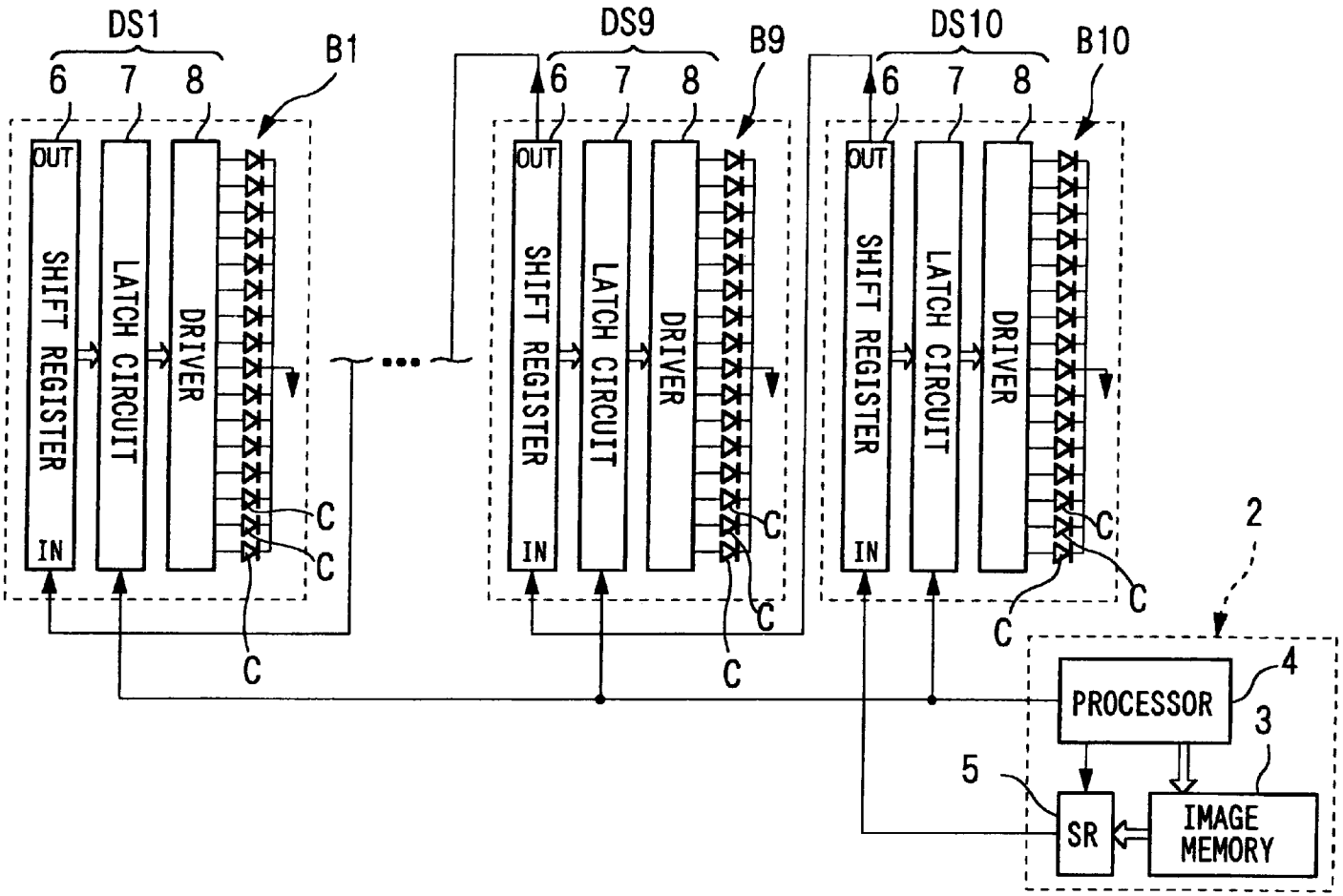
FIG. 5 is a diagrammatic view of a scrolling display apparatus according to an embodiment of the present invention.

A circuit construction of a scrolling display apparatus which conforms to the description of FIGS. 1 to 3, is shown in FIG. 5. As described above, each of the bar-shaped display elements Bi wherein sixteen (16) light emitting cells C are arranged linearly has a drive circuit DSi of sixteen (16) bits provided therefor. The drive circuit DSi includes a shift register 6 of sixteen (16) bits, a latch circuit 7 of sixteen (16) bits and a driver 8 of sixteen (16) bits formed as a unitary member. The shift registers 6 of the n=ten (10) drive circuits DSi are connected in series so as to generally form a shift register of (16×10) bits.

Image data of the bit map type of a size wherein one column includes sixteen (16) bits and one row has a free length are stored in an image memory 3 of a central control unit 2. Of the image data, data of sixteen (16) bits of each column is referred to as column data, and the individual column data are successively numbered as D1, D2, D3, . . . (a general term is represented as Dj). Meanwhile, it is assumed that the image memory 3 has a construction of sixteen (16) bits for one word, and column data Dj is stored in an address j.

A processor 4 of the central control unit 2 read accesses the image memory 3 in the following manner. Column data Dj of sixteen (16) bits read out parallel from the image memory 3 are converted into serial data by a parallel/serial conversion shift register 5 and inputted to the (16×10) bit shift register wherein the n 16-bit shift register 6 are connected in series as described above. By inputting column data for ten (10) columns in series from the central control unit 2 to the (16×10) bit shift resister, column data of sixteen (16) bits are provided individually to the ten (10) 16-bit shift register 6. At this point of time, a latch signal is provided from the central control unit 2 to the drive circuits DSi to transfer the data of the shift registers 6 to the latch circuits 7, and the light emitting cells C are driven with the data by the drivers 8. Simultaneously, the data of the shift registers 6 are updated. Scrolling displaying is performed by repeating the operations described above.

In short, the scrolling display apparatus of FIG. 5 includes data distribution means for specifying image data for w=55 columns of one frame to be displayed subsequently from among entire image data produced in the form of a bit map and stored in the image memory 3 in accordance with a frame address and for selecting image data for n=10 columns at intervals from the image data for fifty five (55) columns of one frame and distributing the selected image data to the ten (10) bar-shaped display elements B1 to B10, light emission driving means for controlling and driving the sixteen (16) light emitting cells C of each of the bar-shaped display elements Bi in accordance with the image data of m=16 dots for one column received from the data distribution means at a predetermined timing, and frame shifting means for successively updating the frame address to successively shift the frame to be specified from within the entire image data in a scrolling direction.

====Arrangement Distances of Bar-Shaped Display Elements Bi and Data Distribution Control ====

The processor 4 which serves as the center of the data distribution means includes means for storing a standard value "6" set corresponding to a standard arrangement distance of the bar-shaped display elements B1 to B10 as the interval control variable mentioned hereinabove, and means for storing a correction value "+2" set for the particular bar-shaped display element B8 arranged in a displaced condition from the standard arrangement distance, and selectively extracts image data for one column to be distributed to each of the bar-shaped display elements B1 to B10 in the following manner based on the set contents "standard value: 6" and "correction value: B8=+2".

Referring to FIG. 2 which illustrates the relationship between the physical screen and the imaginary screen described above, except the eighth (8th) bar-shaped display element B8, all of the other bar-shaped display units are arranged at intervals of six (6) dots on the imaginary screen. The particular bar-shaped display element B8 is arranged at a location displaced by two (2) dots rightwardly from the standard arrangement position at the 6-bit distance. In short, the distance between the bar-shaped display elements B8 and B19 is larger by two (2) dots than the standard value "6" and corresponds to eight (8) bits. Further, the distance between the bar-shaped display elements B8 and B21 is smaller by two (2) dots than the standard value "6" and corresponds to four (4) dots. They are the set contents of "standard value: 6" and "correction value: B8=+2" regarding the interval control variable described hereinabove.

Figure 6:
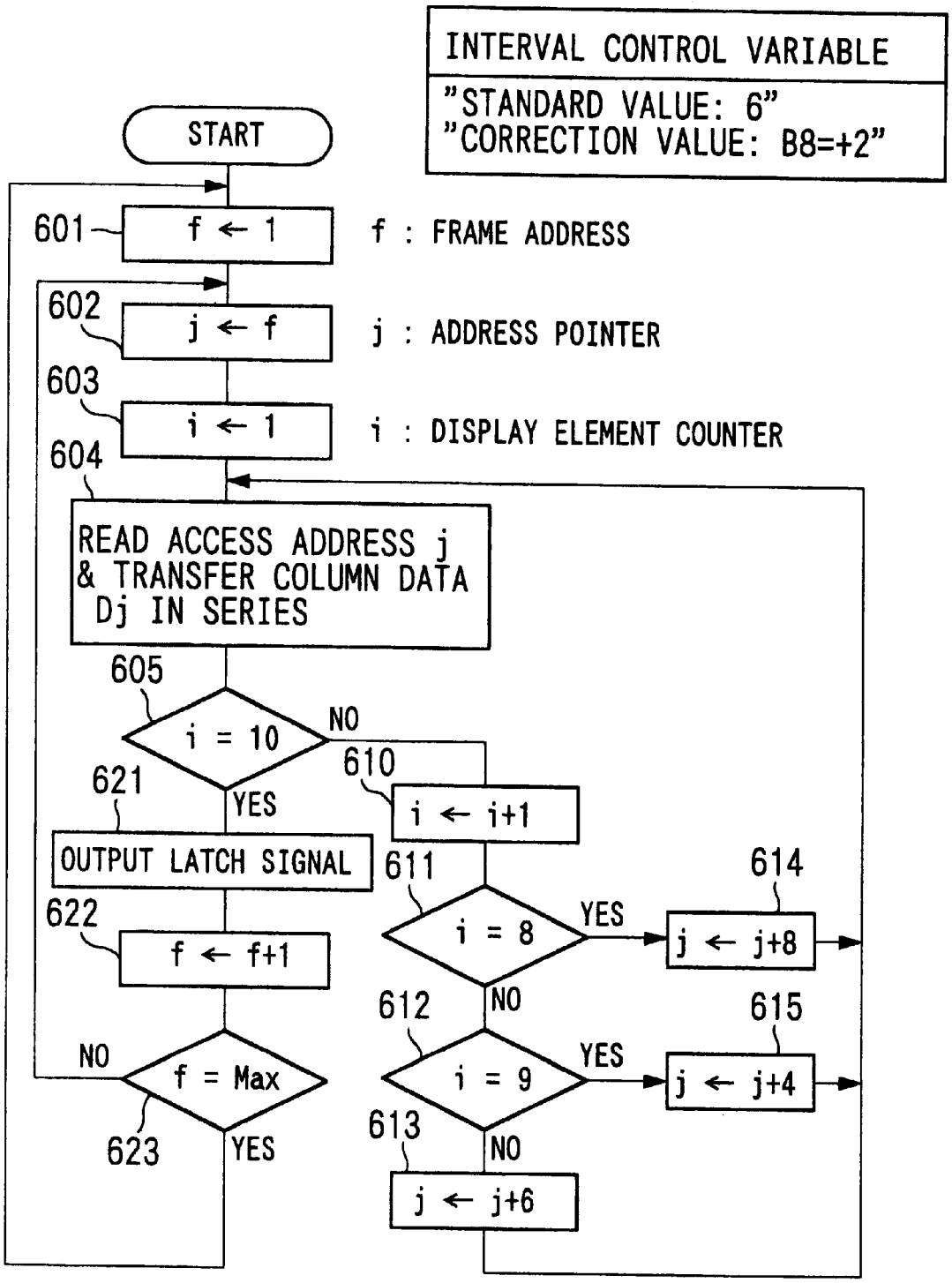
FIG. 6 is a flow chart illustrating an example of an algorithm of data distribution control of the apparatus of one embodiment.

A control procedure as the data distribution means by the processor 4 is illustrated in a flow chart of FIG. 6. It is assumed that, in this operation example, the contents mentioned above are set as the interval control variable.

In first step 601, the value of a frame address f is set to one (1), and in next step 602, the value of the frame address f is transferred to an address pointer j (in this stage of the description, j=P=1). Then, in step 603, the value of a display element counter i is set to one (1). In next step 604, the image memory 3 is read accessed with the address j indicated by the address pointer j, and column data Dj thus read out is transferred in series in such a manner as described hereinabove. In the description till now, the column data D1 is transferred in series.

In next step 605, it is checked whether or not the value of the display element counter i is "10" which indicates the last tenth (10th) bar-shaped display element B10. Since i=1 in the description till now, the processing advances to step 610, in which the display element counter i is incremented by one (1). In the flow of description,i=2.

In next step 611, it is checked whether or not the value of the display element counter i is "8" which indicates the eighth bar-shaped display element B8 for which a correction value is set in the interval control variable. If i=8 is not detected, then it is checked in step 612 whether or not i=8+1=9.

If i=8 or i=9 is not detected, then the processing advances to step 613, in which six (6) is added to the value of the address pointer j. The added value six (6) is the value prescribed by the "standard value: 6" of the interval control variable. Then, the processing returns to step 604, in which the image memory 3 is read accessed with the address j which has increased by six (6) and column data Dj thus read out is transferred in series. In the description till now, column data D7 is transferred in series.

While the display unit counter i is incremented in such a manner as described above, the steps 610→611→612→613→604→605→610 are repetitively executed seven times until i=8 is reached. Consequently, from the central control unit 2, column data for seven (7) columns are successively outputted in series in order of D1→D7→D13→D19→D25→D31→D37.

Then, when i=8 is reached, the processing advances from step 611 to step 614, in which 6+2=8 is added to the value of the address pointer j. This is performed in accordance with the setting of the "correction value: B8=+2" of the interval control variable. Then,since the processing returns to step 604, column data D45 is now read out and transferred in series (37+8=45).

Then, since i=9 is detected when the step 610 is executed, the processing advances to steps 611→612→615, and 6−2=4 is added to the value of the address pointer j as processing incidental to the setting of the "correction value: B8=+2" of the interval control variable. Then, since the processing returns to step 604, column data D49 is now read out and transferred in series (45+4=49). Then, since i=10 is detected when the display element counter i is incremented subsequently, the step 613 is executed again to add six (6) to the value of the address pointer j, and then column data D55 is read out and transferred in series in step 604.

Since i=10 is detected, the discrimination in step 605 becomes YES, and the processing advances to step 621, in which a latch signal is supplied to the drive circuits DS1 to DS10. In the description till now, column data for ten (10) columns are outputted in order of D1→D7→D13→D19→D25→D31→D37→D45→D49→D55, and they are latched by the latch circuits 7 of the ten (10) bar-shaped display elements B1 to B10 and displayed simultaneously. In short, the ten (10) bar-shaped display elements B1 to B10 are driven to display in the following relationship:

The bar-shaped display element B1 is driven with the column data D1.

The bar-shaped display element B2 is driven with the column data D7 (=1+6).

The bar-shaped display element B3 is driven with the column data D13 (=7+6).

The bar-shaped display element B4 is driven with the column data D19 (=13+6).

The bar-shaped display element B5 is driven with the column data D25 (=19+6).

The bar-shaped display element B6 is driven with the column data D31 (=25+6).

The bar-shaped display element B7 is driven with the column data D37 (=31+6).

The bar-shaped display element B8 is driven with the column data D45 (=37+6+2).

The bar-shaped display element B9 is driven with the column data D49 (=45+6−2).

The bar-shaped display element B10 is driven with the column data D55 (=49+6).

In next step 622, the value of the frame address f is incremented by one. In next step 623, it is checked whether or not the incremented value of f is a final value Max. In the description till now, f=2, and in this instance, the processing returns to step 602, in which the value of f is copied into j (j=f=2). Then in step 603, i is initialized to i=c, and the processing described above is executed. Accordingly, the column data are distributed to the ten (10) bar-shaped display elements B1 to B10 and the bar-shaped display elements Bi are driven to display in accordance with the column data Di in the following relationship:

The bar-shaped display element B1 is driven with the column data D2.

The bar-shaped display element B2 is driven with the column data D8 (=2+6).

The bar-shaped display element B3 is driven with the column data D14 (=8+6).

The bar-shaped display element B4 is driven with the column data D20 (=14+6).

The bar-shaped display element B5 is driven with the column data D26 (=20+6).

The bar-shaped display element B6 is driven with the column data D32 (=26+6).

The bar-shaped display element B7 is driven with the column data D38 (=32+6).

The bar-shaped display element B8 is driven with the column data D46 (=38+6+2).

The bar-shaped display element B9 is driven with the column data D50 (=46+6−2).

The bar-shaped display element B10 is driven with the column data D56 (=50+6).

The foregoing processing is executed at a high speed. In short, from among entire image data produced in the form of a bit map and stored in the image memory 3, image data for fifty five (55) columns of one frame to be displayed subsequently are specified in accordance with the frame address f, and image data for ten (10) columns are selected at intervals from the image data for fifty five (55) columns of one frame and distributed to the ten (10) bar-shaped display elements B1 to B10. In each of the bar-shaped display elements Bi, the sixteen (16) light emitting cells C are controlled and driven at a predetermined timing in accordance with the image data Di of sixteen (16) bits for one column distributed thereto. Further, the frame address f is successively updated so that the frame to be specified from within the entire image data is successively shifted in the scrolling direction. As a result, as seen in FIG. 4, a scrolling image of a density wherein one column includes sixteen (16) bits and one row includes fifty five (55) dots is visually observed by an after-image effect of a person who watches the imaginary screen.

If the frame address f becomes equal to the final value Max as a result of scrolling of the image, then the processing returns from step 623 to first step 601, in which the frame address f is initialized to one (1) to thereafter repeat the processing described above. It is to be noted that, if a series of images are scrolling displayed once or a plurality of times, then different images can be scrolling displayed successively by a different process in which the bit map data of a display object area of the image memory 3 are rewritten or the display object area is switched to another storage area for bit map data of another image.

====Arrangement of Bar-Shaped Display Elements and Interval Control Variable====

Figure 7:
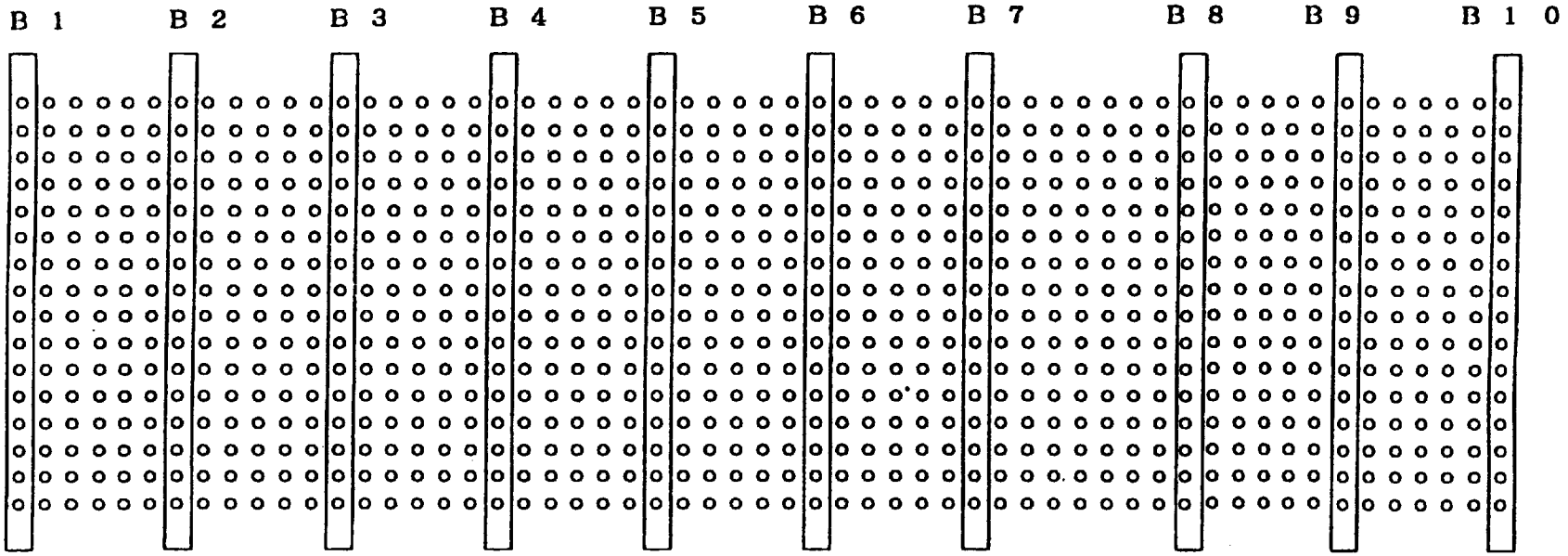
FIG. 7 is a schematic view of a screen construction wherein the manner of arrangement of bar-shaped display elements of FIG. 2 is modified a little.

An example wherein the manner of arrangement of the bar-shaped display elements B1 to B10 of FIG. 2 is modified a little is shown in FIG. 7. In FIG. 7, the bar-shaped display elements B1 to B7 are arranged at intervals of six (6) dots, and an 8-bit distance is provided between the bar-shaped display elements B7 and B8. This is same as that in FIG. 2, and what is different is that a standard six (6) dot distance is provided between the bar-shaped display elements B8 and B9. A six (6) dot distance is provided between the bar-shaped display elements B9 and B10.

Where the certain one bar-shaped display element B8 is installed at a position displaced from a standard position as seen in FIG. 7, the setting method may be prescribed such that the distance between the bar-shaped display element B8 and the succeeding bar-shaped display element B9 may be returned to the standard six (6) bit distance. In this instance, the dot construction of the imaginary screen described above exhibits an increase of two (2) columns and includes 16 dots×57 dots. The interval control variable corresponding to the embodiment of FIG. 7 may be contents of setting of "standard value: 6" and "correction value: B8=+2" similarly to those given hereinabove. However, the algorithm for data distribution control must be modified a little from that of FIG. 6. In short, in the flow chart of FIG. 6, the processing in step 612 and step 615 is omitted, and column data later by six (6) columns than column data distributed for B8 is distributed for B9.

By setting the rule regarding the arrangement method of the bar-shaped display elements, the method of determination of the interval control variable and the algorithm for data distribution control such that they match each other, when it is tried to install a large number of bar-shaped display elements at a site in any of various situations to work the present invention, even if the distances between the bar-shaped display elements are not necessarily be fixed, an image of a correct aspect ratio over the entire screen can be displayed without distorting the displayed image.

====Man-machine Interface====

In the construction of FIG.5, the central control unit 2 which serves as the center of the present system can be realized by adding required hardware and software to an ordinary personal computer. Since an ordinary personal computer includes a keyboard and a display unit, a man-machine interface for arbitrarily setting the interval control variable may be implemented making use of this. In short, a system may be constructed such that a setting screen for the interval control variable is displayed on the display unit and a suitable numerical value is written in the screen by inputting from the keyboard.

It is naturally possible to construct the central control unit 2 as an exclusive machine in such a form that it does not have an advanced man-machine interface resource such as a keyboard or a display unit of a personal computer. In this instance, in order to arbitrarily set the interval control variable, the system is constructed such that several kinds of digital switches are provided and a suitable numerical value or the like is set using the switches.

As described in detail above, with the scrolling display method and apparatus of the present invention, the following significant effects are presented:

(a) A definite image of a large size can be scrolling displayed with a small number of light emitting cells;

(b) A scrolling display screen of a large size can be realized not in an apparatus form of a display panel of a rigid body having a size a little larger than a display size but in a flexible apparatus form wherein a large number of bar-shaped display elements are arranged at suitable distances; and (c) In working the present invention by installing a large number of bar-shaped display elements at a site in any of various situations, even if the distances between the bar-shaped display elements are not necessarily fixed, an image of an aspect ratio which is correct over an entire screen can be displayed without distorting the displayed image.

What is claimed is:

1. A scrolling display method, comprising the following steps of:

arranging n bar-shaped display elements substantially in parallel to each other at suitable distances from each other, each said bar-shaped display element including m light emitting cells positioned linearly and closely at short distances, so that, by the arrangement, said n bar-shaped display elements are connected to each other like a belt to form a physical screen wherein one column includes m dots and one row includes n dots, an average value of the distances between said adjacent display elements being larger than five times as large as the cell distance in one of said bar-shaped display elements:

assuming said physical screen of a pixel construction wherein one column includes m dots and one row includes n dots as an imaginary screen of another pixel construction wherein one column includes m dots and one row includes w dots, and producing image data of the bit map type assuming that an image is displayed in the dot density on said imaginary screen, where w is an integer larger than several times as large as n;

distributing those image data for n columns selected at intervals from among the image data for w columns actually to said n bar-shaped display elements, and controlling to drive said m light emitting cells of each of said bar-shaped display elements in accordance with data of m dots for each column, in case that it is assumed that bit map screen data wherein one column includes m dots and one row includes w dots are expanded on said imaginary screen to display the data;

in the control to select image data for n columns at intervals from among image data for w columns and distribute the selected image data to said n bar-shaped display elements, selecting the column data in the bitmap screen data at intervals according to an interval control variable arbitrarily determined in accordance with the arrangement distances of said bar-shaped display elements distributed and arranged on said imaginary screen; and while those bit map image data to be expanded on said imaginary screen are successively shifted in a direction of a row, repeating data processing for controlling and driving said light emitting cells of said bar-shaped display elements in accordance with image data selected at intervals so that a scrolling image of a dot density wherein one column includes m dots and one row includes w dots, may be visually observed by an after-image effect of a person who watches said imaginary screen.

2. A scrolling display apparatus, wherein n bar-shaped display elements, each of which including m light emitting cells positioned linearly and closely at short distances, are arranged substantially in parallel to each other at suitable distances from each other, so that, by the arrangement, said n bar-shaped display elements are connected to each other like a belt to form a physical screen wherein one column includes m dots and one row includes n dots, and an average value of the distances between said adjacent display elements is larger than five times as large as the cell distance in one of said bar-shaped display elements, said physical screen of a pixel construction wherein one column includes m dots and one row includes n dots, is assumed as an imaginary screen of another pixel construction wherein one column includes m dots and one row includes w dots, and image data of the bit map type are produced assuming that an image is displayed in the dot density on said imaginary screen, where w is an integer larger than several times as large as n, those image data for n columns selected at intervals from among the image data for w columns are actually distributed to said n bar-shaped display elements, and said m light emitting cells of each of said bar-shaped display elements are controlled and driven in accordance with data of m dots for each column, in case that it is assumed that bit map screen data wherein one column includes m dots and one row includes w dots are expanded on said imaginary screen to display the data, in the control to select image data for n columns at intervals from among image data for w columns and distribute the selected image data to said n bar-shaped display elements, the column data in the bitmap screen data are selected at intervals according to an interval control variable arbitrarily determined in accordance with the arrangement distances of said bar-shaped display elements distributed and arranged on said imaginary screen, and while those bit map image data to be expanded on said imaginary screen are successively shifted in a direction of a row, data processing for controlling and driving said light emitting cells of said bar-shaped display elements are repeated in accordance with image data selected at intervals so that a scrolling image of a dot density wherein one column includes m dots and one row includes w dots, may be visually observed by an after-image effect of a person who watches said imaginary screen, further comprising:

data distribution means for specifying image data for w columns of one frame to be displayed subsequently from among entire image data produced in the form of a bit map and stored in a memory in accordance with a frame address, and for selecting image data for n columns at intervals from the image data for w columns of one frame and distributing the selected image data to said bar-shaped display elements;

light emission driving means for controlling and driving said m light emitting cells of each said bar-shaped display element in accordance with the image data of m dots for one column received from said data distribution means at a predetermined timing; and frame shifting means for successively updating the frame address to successively shift the frame to be specified from within the entire image data in a scrolling direction.

3. A scrolling display apparatus as set forth in claim 2, wherein said data distribution means includes means for storing a standard value set corresponding to a standard arrangement distance of said bar-shaped display elements as the interval control variable, and means for storing a correction value set for a particular one of said bar-shaped display elements which is arranged in a displaced condition from the standard arrangement distance, and said data distribution means selectively extracts image data for one column to be distributed to each said bar-shaped display element based on the standard value and the correction value.

4. A scrolling display apparatus as set forth in claim 3, further comprising:

means for arbitrarily setting and inputting the standard value; and means for setting and inputting the correction value in a corresponding relationship to an identifier of a pertaining one of said bar-shaped display elements, both as a man-machine interface.

5. A scrolling display apparatus as set forth in claim 2, wherein said data distribution means includes means for storing, as the interval control variable, position data set proportionally corresponding to the arrangement position of each said bar-shaped display element from an origin, and selectively extracts image data for one column to be distributed to each said bar-shaped display element based on the position data.

6. A scrolling display apparatus as set forth in claim 5, further comprising means for setting and inputting the position data in a corresponding relationship to an identifier of each said bar-shaped display element as a man-machine interface.

7. A scrolling display apparatus as set forth in claim 2, wherein said data distribution means includes means for storing, as the interval control variable, distance data set proportionally corresponding to the distance of each said bar-shaped display element from an adjacent one of said bar-shaped display elements, and selectively extracts image data for one column to be distributed to each said bar-shaped display element based on the distance data.

8. A scrolling display apparatus as set forth in claim 7, further comprising means for setting and inputting the distance data in a corresponding relationship to an identifier of each said bar-shaped display element as a man-machine interface.

* * * * *